US008650816B1

(12) United States Patent
West

(10) Patent No.: US 8,650,816 B1
(45) Date of Patent: Feb. 18, 2014

(54) STAIRS AND MEZZANINE AND METHOD FOR CONSTRUCTING SAME

(71) Applicant: Wendell West, Tulsa, OK (US)

(72) Inventor: Wendell West, Tulsa, OK (US)

( * ) Notice: Subject to any disclaimer, the term of this patent is extended or adjusted under 35 U.S.C. 154(b) by 0 days.

(21) Appl. No.: 13/735,436

(22) Filed: Jan. 7, 2013

(51) Int. Cl.
*E04F 11/025* (2006.01)
*E04F 11/00* (2006.01)
*E04F 19/10* (2006.01)

(52) U.S. Cl.
CPC ..... *E04F 11/025* (2013.01)
USPC ..... 52/185; 52/182; 52/191

(58) Field of Classification Search
CPC ..... E04F 11/02; E04F 11/022; E04F 11/0223; E04F 11/025; E04F 11/028; E04F 11/035; E04F 11/09; E04F 11/116; E04F 211/02; E04F 2011/0212
USPC ..... 52/182, 184, 185, 186, 188, 189, 190, 52/191, 741.2; 249/14
See application file for complete search history.

(56) References Cited

U.S. PATENT DOCUMENTS

| | | | | | |
|---|---|---|---|---|---|
| 829,107 | A * | 8/1906 | Grossman | 52/188 |
| 1,069,596 | A * | 8/1913 | Baldry | 52/188 |
| 1,078,403 | A * | 11/1913 | Anderson | 52/188 |
| 1,257,221 | A * | 2/1918 | Grossman | 52/188 |
| 1,420,294 | A * | 6/1922 | Swanson | 52/188 |
| 1,541,571 | A * | 6/1925 | Hughes | 52/690 |
| 1,771,405 | A * | 7/1930 | Felsenthal | 52/191 |
| 1,789,574 | A * | 1/1931 | Woodbridge | 52/250 |
| 1,862,958 | A * | 6/1932 | Hall | 52/191 |
| 2,015,945 | A * | 10/1935 | MacDonald | 52/191 |
| 2,610,380 | A * | 9/1952 | Pollman | 249/14 |
| 2,721,472 | A * | 10/1955 | McAver | 52/191 |
| 2,949,703 | A * | 8/1960 | Katzmarek | 52/188 |
| 3,788,018 | A * | 1/1974 | Simmons et al. | 52/185 |
| 3,839,840 | A * | 10/1974 | Miller | 52/741.2 |
| 3,859,771 | A * | 1/1975 | Simmons et al. | 52/741.2 |
| 3,994,113 | A * | 11/1976 | Souza, Jr. | 52/741.2 |
| 4,124,957 | A * | 11/1978 | Poulain | 52/183 |
| 4,250,672 | A * | 2/1981 | Seegers et al. | 52/182 |
| 4,593,503 | A | 6/1986 | Koslowski | |
| 4,757,653 | A | 7/1988 | Anderholm | |
| 4,899,504 | A * | 2/1990 | Hirschhorn | 52/182 |
| 5,014,475 | A * | 5/1991 | Anderson et al. | 52/191 |
| 5,660,009 | A * | 8/1997 | Cousin | 52/183 |
| 2003/0208971 | A1 * | 11/2003 | Couture | 52/182 |
| 2008/0115429 | A1 * | 5/2008 | Zirbel et al. | 52/189 |
| 2012/0167521 | A1 * | 7/2012 | Cretti | 52/741.2 |

* cited by examiner

*Primary Examiner* — Ryan Kwiecinski
(74) *Attorney, Agent, or Firm* — Molly D. McKay

(57) ABSTRACT

The present invention relates to improved stairs and mezzanine that are constructed of standard steel structural components with poured concrete stair treads and the associated method for making them. The invention employs standard steel structural components to make a staircase frame that is stronger, is faster to construct, and is less expensive than those made by current methods. The framework for the staircase is constructed of steel studs, u-channel members, and metal deck material that are cut to size and screwed together. Once the metal framework is constructed and any openings caulked, concrete is poured within the framework to form the concrete steps for the stairs and any associated intermediate platform or mezzanine. Once the concrete is dry, the stairs may be painted, carpeted, or finished as desired.

7 Claims, 4 Drawing Sheets

STAIRS AND MEZZANINE AND METHOD FOR CONSTRUCTING SAME

CROSS-REFERENCE TO RELATED APPLICATIONS

The present application claims priority to U.S. Provisional Patent Application Ser. No. 61/645,688 filed on May 11, 2012 for Stairs & Mezzanine and Method for Constructing Same.

BACKGROUND OF THE INVENTION

1. Field of the Invention

The present invention relates to improved stairs and mezzanine that are constructed of standard steel structural components with poured concrete stair treads and the associated method for making them. The invention employs standard steel structural components to make a staircase frame that is stronger, is faster to construct, and is less expensive than those made by current methods.

2. Description of the Related Art

Staircases in most commercial buildings and in some residential buildings are custom made to fit the space requirements of the building and employ poured concrete steps or treads.

One method of making these staircases is to first fabricate the metal framework in a shop and then transport the framework to the building site where it is installed as the building is being built. Thereafter concrete is poured in the pans of the metal framework to form the treads of the stairs. This method is extremely time consuming and expensive.

Another method of making these staircases that is less expensive, but produces a lesser quality product is to fabricate the metal pans in a shop and then transport them to the building site where the pans are then attached to stringers to complete the framework. Thereafter concrete is poured in the pans to form the treads of the stairs.

Both of these methods are costly and time consuming to construct, and both produce staircases that make a hollow sound when stepped upon, making them feel less than secure to the person using the stairs.

SUMMARY OF THE INVENTION

The present invention is a staircase having stairs and mezzanine that are constructed of standard steel structural components with poured concrete stair treads and the associated method for making them. The invention employs readily available, standard steel structural components to make a staircase frame that is stronger, is faster to construct, and is less expensive than those made by current methods.

The invention employs stringers on either side of the stairwell that are each constructed of two items. First, on either side of the stairwell, a 2×12, 14-gauge steel stud is secured via screws to the vertical oriented and normally 2×6, 16-gauge steel studs of the building's walls such that the 2×12, 14-gauge steel stud for the stringer is at the appropriate slope or pitch for the desired stairs. The ends of the steel studs are cut at appropriate angles so that when installed, the ends of the steel studs are flush with the floors of the building or are flush with one floor of the building and with an intermediate landing for the staircase, as the style of the staircase to be built dictates.

If an intermediate landing is employed in the staircase, the same type of stringers employed on either side of the stairwell are secured to the walls of the stairwell horizontally around where the intermediate landing will be built as a surface against which the platform box is secured and into which concrete is to be poured to create the poured concrete mezzanine floor or intermediate landing.

Next, a 2×12, 14 gauge steel u-channel is secured over each of the 2×12, 14-gauge steel studs of the stringer and secured by means of screws. The 2×12, 14 gauge steel u-channels also have their ends cut at appropriate angles so that when installed, their ends are flush with the floors of the building or flush with one floor of the building and with an intermediate landing for the staircase, as the style of staircase dictates. Together each steel stud and it associated u-channel function as a unit as one of the two stringers for one flight of stairs. Obviously if multiple flights of stairs are to be installed or if the staircase is to have an intermediate landing, then more than two stringers will be needed to complete the entire staircase.

If an intermediate landing or mezzanine is to be employed in the staircase, a platform box for the landing will be constructed in place within the stairwell at the appropriate location and height. The intermediate platform consists of a box similar to the step boxes that will be constructed later, only the landing box is built in place instead of being prefabricated before being installed. The landing or platform box will be built in place in the shape of the desired intermediate platform or landing. Also, the intermediate platform will be constructed with 2×12, 14 gauge studs cut to the width of the landing and 2×12, 14 gauge u-channels cut to the depth of the landing, with additional 2×12, 14 gauge studs being secured to the platform box between the outside stud framing members to provide additional strength and support as needed depending on the size of the platform to be constructed. Once the framework for the platform box has been created, then one or more pieces of 24 gauge metal deck material are secured via screws to the top of the box to create the bottom of a form into which concrete will later be poured to create the concrete platform. Although the metal deck material shown in the drawings is shown as being corrugated to increase its strength, the invention is not so limited and non-corrugated metal deck material may be employed for this purpose, if desired.

Once the framework for the platform box has been created, then one or more pieces of 24 gauge metal deck material are secured via screws to the top of the box to create the bottom of a form into which concrete will later be poured to create the concrete platform. Although the metal deck material shown in the drawings is shown as being corrugated to increase its strength, the invention is not so limited and non-corrugated metal deck material may be employed for this purpose, if desired.

Once the stringers have been thus secured in place, and if needed a platform box has been constructed, a step box is then constructed for each of the steps in the staircase. Each step will require the construction of a step box. Each step box is constructed by using two 2×6, 16 gauge studs cut to the width of the steps and two 2×6, 16 gauge u-channels cut to the depth of the steps. These four components are screwed together so that the studs are parallel with each other and the u-channels are parallel with each other to form the step boxes. The step boxes are constructed before being installed in the stairwell and thus can be prefabricated on site or off site, as desired.

Similar to the construction of the platform box, once the framework for the step boxes have been created, then pieces of 24 gauge metal deck material are secured via screws to the top of the step boxes to create the bottom of a form into which concrete will later be poured to create the concrete steps. Although the metal deck material shown in the drawings is shown as being corrugated to increase its strength, the invention is not so limited and non-corrugated metal deck material may be employed for this purpose, if desired. The metal deck material may be secured to the step boxes either before or after the boxes are attached to the stringers.

Next, the framework for the stair is constructed using the step boxes and u-channels. Although the stairs can be constructed from the bottom up, it is generally easier to construct them from the top down. Each riser is constructed of 2×12, 14 gauge u-channel cut to the width of the stairs.

Each of the u-channels is 2×12, 14 gauge. The uppermost u-channel is secured to either the upper floor or to the intermediate platform box via screws, depending on the style of the staircase to be built. If the u-channel is to be secured to the upper floor, it is secured to the upper floor so that the upper leg of the u-channel is horizontal in orientation and extends in the direction of or toward the floor instead of toward the step. The upper leg of the u-channel is either installed flush with the floor or is installed at the desired height above the upper floor so that the upper leg serves as the edge for tile, carpet or a poured cement floor that will be installed on the upper floor. The middle portion of the u-channel will serve as the riser for the step located immediately below and adjacent to the upper floor, with the lower leg of the u-channel being located below the staircase.

Alternately, the u-channel is secured to an intermediate platform box on the side of the platform box that is adjacent to the stairs that lead to the lower floor from the platform. The u-channel is secured to the platform so that the upper leg of the u-channel is horizontally oriented and extends above the intermediate platform box at a desired height. The upper leg of the u-channel is located at a level above the platform box so that concrete can be poured above the platform box to form the platform subsequent to installation of the staircase's metal framework and the upper leg will serve as the front edge of the platform. The middle portion of the u-channel will serve as the riser for the step located immediately below and adjacent to the platform, and the lower leg of the u-channel will be located below the staircase.

Once the first uppermost u-channel is secured to either the upper floor or to the intermediate platform box via screws, the framework for the remaining underlying stair are built sequentially by first securing the next lower stair box to the previously install u-channel and to the risers via screws, and then securing the next u-channel to the previously installed stair box. Each subsequent u-channel is oriented so that the upper leg of the u-channel extends in the direction of the previously installed stair box or platform box and is at the appropriate height to be level with the step or platform that will be created when concrete is poured over the previously installed stair box or platform box. This requires that the upper leg of the subsequent u-channels are installed along the stringers at the proper height relative to the previous u-channel and at the proper height above the previously installed step box or platform box to create a concrete form above each step box and above each platform box for pouring concrete on top of the step boxes and platform boxes to form the properly spaced and sized steps of the staircase. The u-channel for the front of the lowest step of the staircase will need to be cut to the desired step height before it is secured in place.

After the metal framework for the staircase has thus been constructed and before the concrete is poured to complete the staircase, it may be desirable to chink, caulk or otherwise seal any cracks in the formed areas where the concrete will be poured to form the steps and platform in order to prevent the wet liquid concrete from seeping out of the framework. Then concrete is poured above the various step boxes and above the platform boxes to the desired depth and the concrete is finished and allowed to dry, thereby structurally completing the staircase. The staircase can then be carpeted, painted or otherwise finished to the customer's specifications.

DETAILED DESCRIPTION OF THE PREFERRED EMBODIMENT

Figure 1:
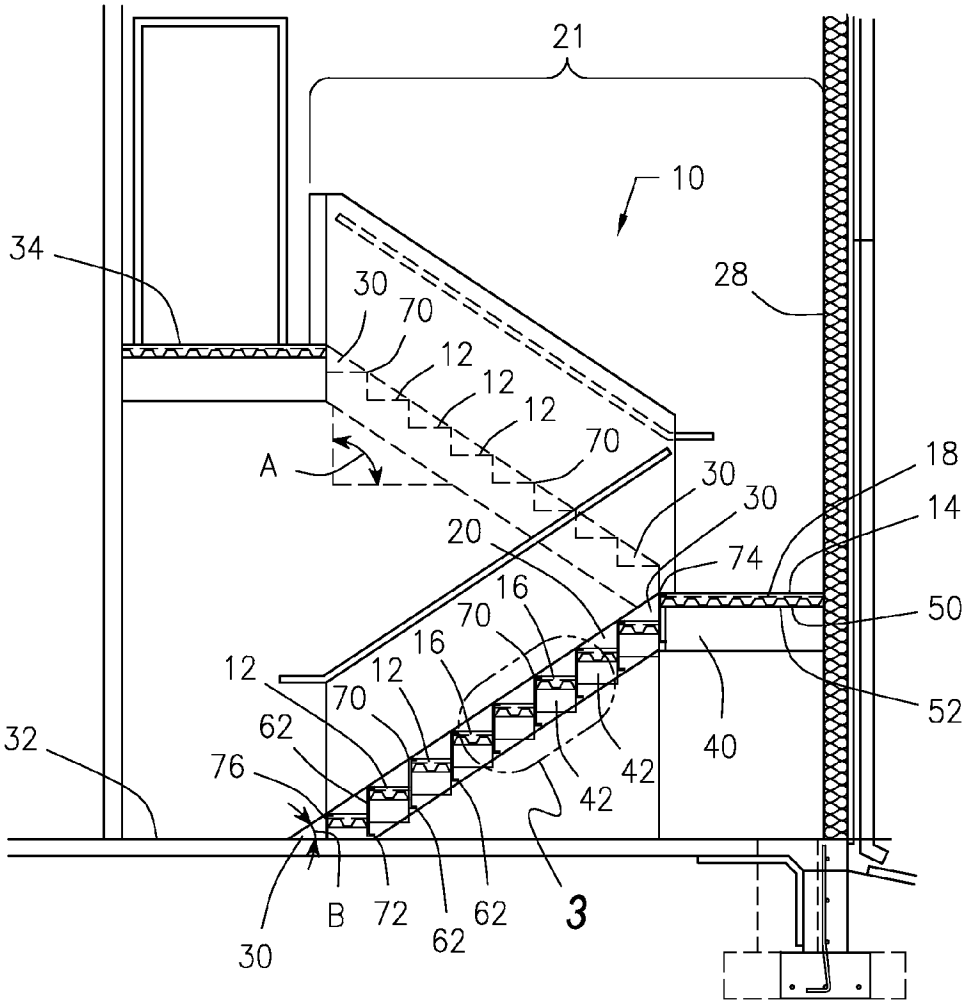
FIG. 1 is a side view in diagram of a typical staircase constructed in accordance with a preferred embodiment of the present invention.
Figure 2:
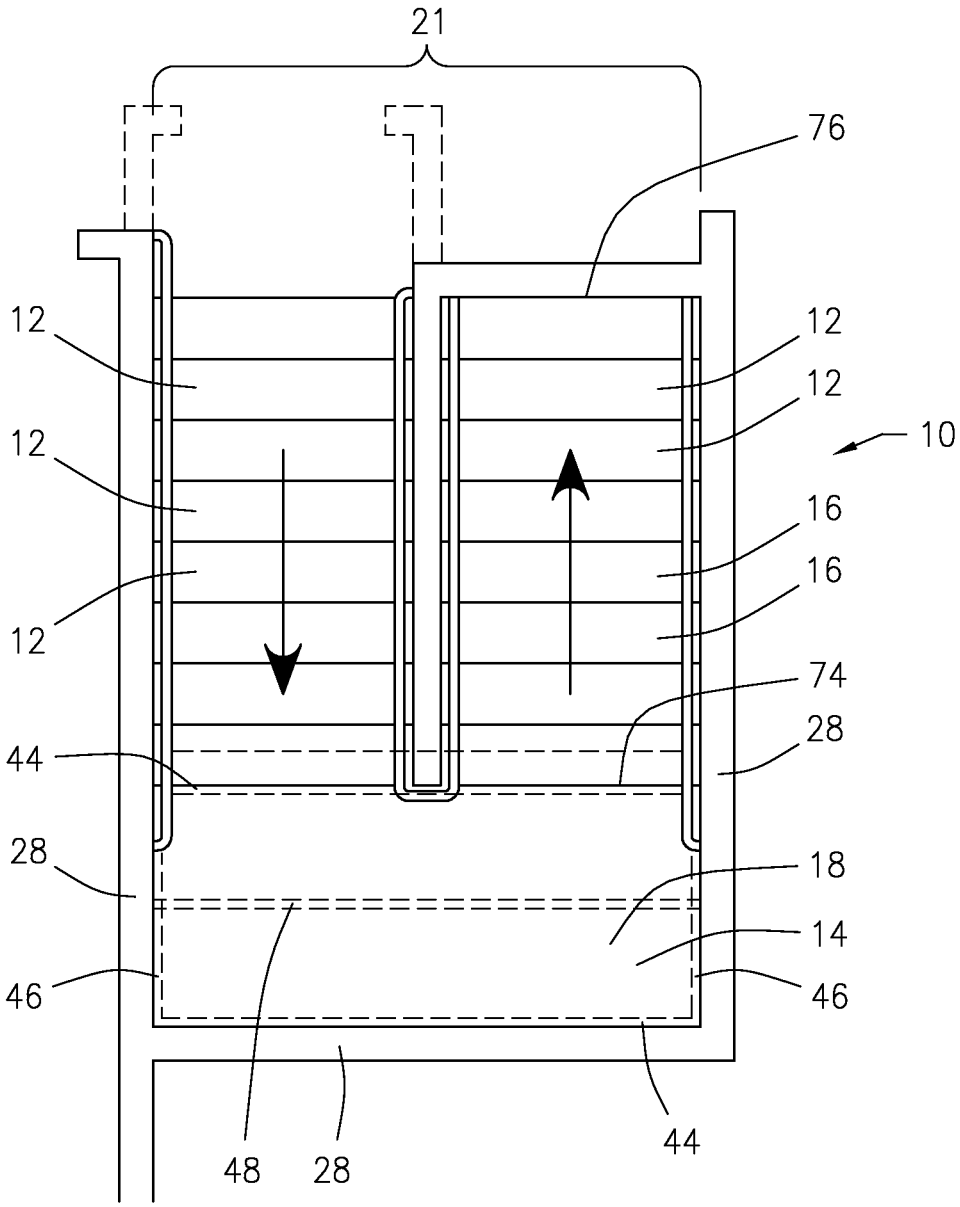
FIG. 2 is a top plan view of the staircase of FIG. 1.
Figure 3:
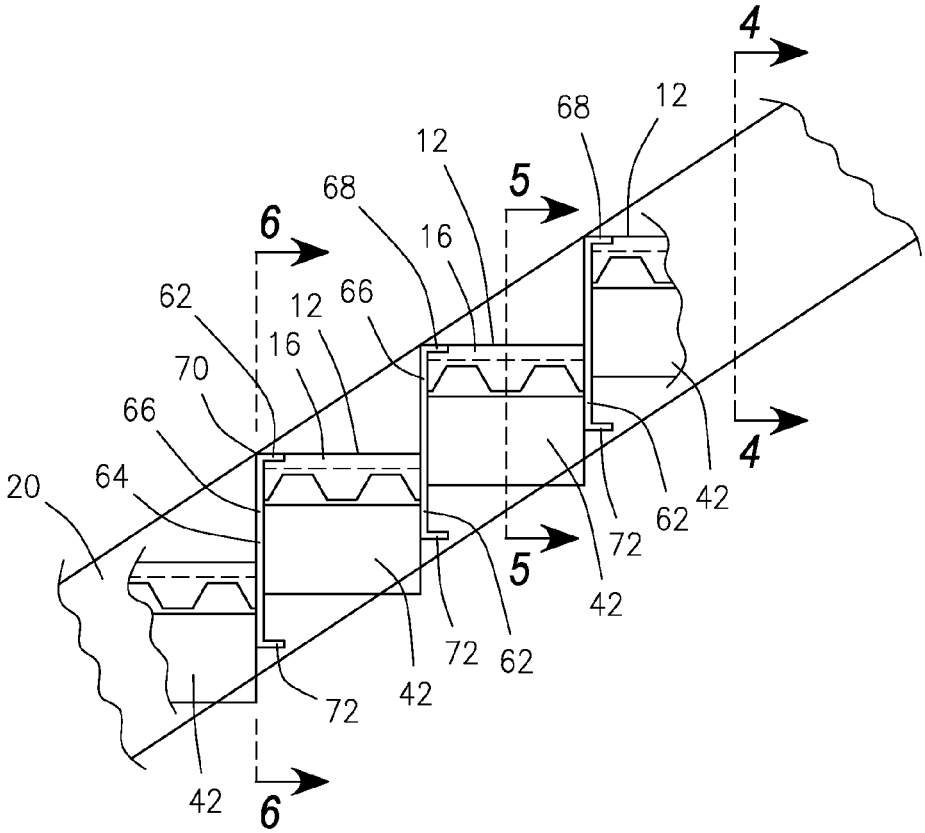
FIG. 3 is an enlarged view of the area within circle 3 of FIG. 1.
Figure 4:
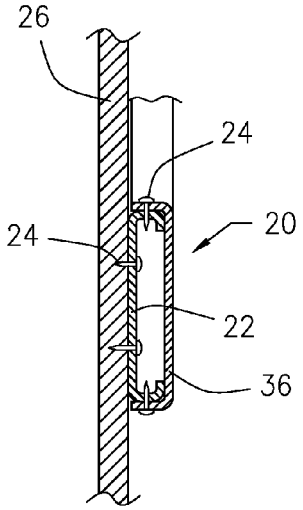
FIG. 4 is a cross sectional view of one stringer taken along line 4-4 of FIG. 3, showing only the stringer and the wall stud to which the stringer is secured.
Figure 5:
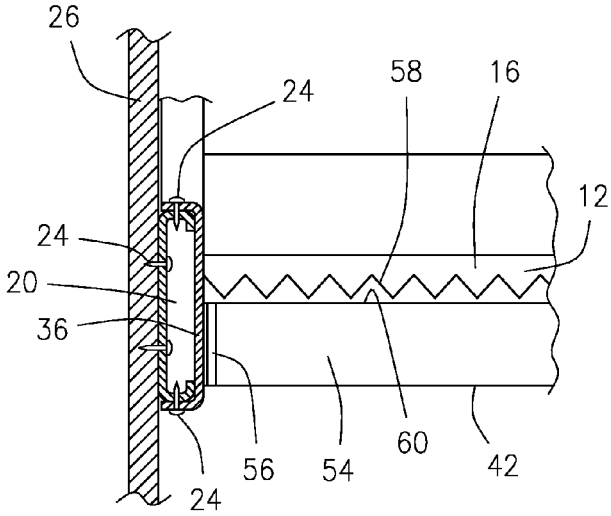
FIG. 5 is a cross sectional view of one stringer and steps taken along line 5-5 of FIG. 3.
Figure 6:
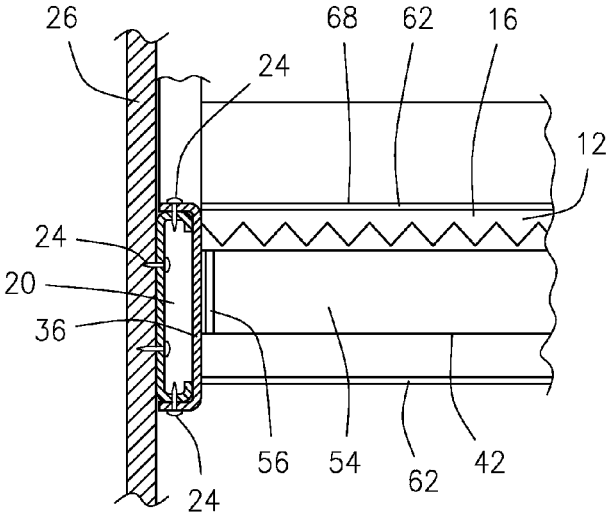
FIG. 6 is a cross sectional view of one stringer and steps taken along line 6-6 of FIG. 3.

Referring now to the drawings, the present invention is a staircase 10 having stairs 12 and mezzanine 14 that are constructed of standard steel structural components with poured concrete stair treads 16 and poured concrete mezzanine floor 18 and the associated method for making them. The invention 10 employs readily available, standard steel structural components to make a staircase frame that is stronger, is faster to construct, and is less expensive than those made by current methods.

The invention 10 employs stringers 20 on either side of the stairwell 21 that are each constructed of two items. First, on either side of the stairwell, a 2×12, 14-gauge steel stud 22 is secured via screws 24 to the vertical oriented and normally 2×6, 16-gauge steel studs 26 of the building's walls 28 such that the 2×12, 14-gauge steel stud 22 for the stringer 20 is at the appropriate slope or pitch A for the desired staircase 10. The ends 30 of the steel studs 22 are cut at appropriate angles B so that when installed, the ends 30 of the steel studs 22 are flush with the floors 32 and 34 of the building or are flush with one floor, either 32 or 34, of the building and flush with an intermediate landing or mezzanine 14 for the staircase, as the style of the staircase 10 to be built dictates.

If an intermediate landing 14 is employed in the staircase 10, the same type of stringers 20 employed on either side of the stairwell 21 are secured to the walls 28 of the stairwell 21 horizontally around where the intermediate landing 14 will be built as a surface against which the platform box 40 is to be secured and into which concrete is to be poured to create the poured concrete mezzanine floor or intermediate landing 18.

Next, a 2×12, 14 gauge steel u-channel 36 is secured over each of the 2×12, 14-gauge steel studs 22 of the stringer 20 and secured by means of screws 24. The 2×12, 14 gauge steel u-channels 36 also have their ends (not illustrated) cut at appropriate angles B so that when installed, their ends (not illustrated) match with the ends 30 of their associated studs 22 and are flush with the floors 32 and 34 of the building or flush with one floor, either 32 or 34, of the building and with an intermediate landing 14 for the staircase 10, as the style of staircase dictates. Together each steel stud 22 and it associated u-channel 36 function as a unit as one of the two stringers 20 for a continuous run or flight of stairs 12. Obviously, if multiple flights of stairs 12 are to be installed or if the staircase 10 is to have an intermediate landing 14, then more than two stringers 20 will be needed to complete construction of the entire staircase 10.

If an intermediate landing or mezzanine 14 is to be employed in the staircase 10, a platform box 40 for the landing 14 will be constructed in place within the stairwell 21 at the appropriate location and height. The intermediate platform 14 consists of a platform box 40 that is constructed similar to the step boxes 42 that will be constructed later, only the landing or platform box 40 is built in place instead of being prefabricated before being installed. The landing or platform box 40 will be built in place in the shape of the desired intermediate platform or landing 14. Also, the intermediate platform box 40 will be constructed with 2×12, 14 gauge studs 44 that are cut to the width of the landing 14 and 2×12, 14 gauge u-channels 46 that are cut to the depth of the landing 14, with additional 2×12, 14 gauge studs 48 being added to the platform box 40 between the outside stud framing members 44 to provide additional strength and support as needed depending on the size of the platform 14 to be constructed.

Once the framework for the platform box 40 has thus been created, then one or more pieces of 24 gauge metal deck material 50 are secured via screws 24 to the top 52 of the platform box 40 to create the bottom of a form into which concrete will later be poured to create the poured concrete mezzanine floor or concrete platform 18. Although the metal deck material 50 illustrated in the drawings is shown as being corrugated to increase its strength, the invention is not so limited and non-corrugated metal deck material may be employed for this purpose, if desired.

Once the stringers 20 have been secured in place, and if needed a platform box 40 has been constructed, a step box 42 is then constructed for each of the steps or stairs 12 in the staircase 10. Each step 12 will require the construction of a step box 42. Each step box 42 is constructed by using two 2×6, 16 gauge studs 54 cut to the width of the steps 12 and two 2×6, 16 gauge u-channels 56 cut to the depth of the steps 12. Although the width of the steps 12 will vary depending on the building specifications, the normal depth of steps 12 is approximately eleven inches and the normal rise of steps is approximately seven inches.

These four components, i.e. two of the studs 54 and two of the u-channels 56, are secured together with screws 24 so that the studs 54 are parallel with each other and the u-channels 56 are parallel with each other to form the framework for the step boxes 42. The step boxes 42 are constructed before being installed in the stairwell 21 and thus can be prefabricated on site or off site, as desired.

Similar to the construction of the platform box 40, once the framework for the step boxes 42 has been created, then pieces of 24 gauge metal deck material 58 are secured via screws 24 to the tops 60 of the step boxes 42 to create the bottom of a form into which concrete will later be poured to create the poured concrete stair treads or concrete steps 16. Although the metal deck material 58 shown in the drawings is illustrated as being corrugated to increase its strength, the invention is not so limited and non-corrugated metal deck material may be employed for this purpose, if desired. The metal deck material 58 may be secured to the step boxes 42 either before or after the step boxes 42 are installed in the stairwell 21 by attaching them to the stringers 20 with screws 24.

Next, the framework for the staircase 10 is constructed using the prefabricated step boxes 42 and u-channels 62. Middle portions 64 of the u-channels 62 will serve as the risers 66 for the steps 12 in the staircase 10 and upper legs 68 of the u-channels 62 will serve as the front edge 70 of the poured concrete stair treads 16. Although the stairs 12 can be constructed from the bottom up, it is generally easier to construct them from the top down. Each riser 66 is constructed from a 2×12, 14 gauge u-channel 62 that is cut to the width of the stairs 12.

The uppermost u-channel 62 is secured to either the upper floor 34 or to the intermediate platform box 40 via screws 24, depending on the style of the staircase 10 to be built. If the uppermost u-channel 62 is to be secured to the upper floor 34, it is secured to the upper floor 34 so that the upper leg 68 of the uppermost u-channel 62 is horizontal in orientation and extends in the direction of or toward the upper floor 34 instead of toward the steps 12. The upper leg 68 of the uppermost u-channel 62 is either installed flush with the floor upper 34 or is installed at the desired height above the upper floor 34 so that the upper leg 68 serves as the edge for tile, carpet or a poured cement floor (not illustrated) that will be installed on the upper floor 34. The middle portion 64 of the u-channel 62 will serve as the riser 66 for the step 12 located immediately below and adjacent to the upper floor 34, with the lower leg 72 of the u-channel 62 being located below the staircase 10.

Alternately, instead of securing to the upper floor 34, the uppermost u-channel 62 for a run of stairs 12 may be secured to an intermediate platform box 40 on the side of the platform box 40 that is adjacent to the run of stairs 12 that lead to the lower floor 32 from the platform 14. In that case, the uppermost u-channel 62 is secured to the platform box 40 so that the upper leg 68 of the u-channel 62 is horizontally oriented and extends above the intermediate platform box 40 at a desired height. The upper leg 68 of the u-channel 62 is located at a level above the platform box 40 so that concrete can be poured above the platform box 40 to form the poured concrete mezzanine floor or platform 18 subsequent to installation of the staircase's metal framework, and the upper leg 68 will serve as the front edge 74 of the mezzanine or platform 14. The middle portion 64 of the u-channel 62 will serve as the riser 66 for the step 12 located immediately below and adjacent to the platform 14, and the lower leg 72 of the u-channel 62 will be located below the platform 14 of the staircase 10.

Once the first uppermost u-channel 62 is secured to either the upper floor 34 or to the intermediate platform box 40 via screws 24, the framework for the remaining underlying stairs 12 are built sequentially by first securing the next lower stair or step box 42 to the previously install u-channel 62 via screws 24, and then securing the next u-channel 62 to the previously installed stair box 42. Each subsequent u-channel 62 is oriented so that the upper leg 68 of the u-channel 62 extends in the direction of the higher adjacent stair box 42 or platform box 40 and is at the appropriate height to be level with the step 12 or platform 14 that will be created when concrete is poured over the previously installed stair box 42 or platform box 40. This requires that the upper leg 68 of the subsequent u-channels 62 are installed along the stringers 20 at the proper height relative to the adjacent previously installed u-channel 62 and at the proper height above the adjacent previously installed step box 42 or platform box 40 to create a concrete form above each step box 42 and above each platform box 40 for pouring concrete on top of the step boxes 42 and platform box 40 to form the properly spaced and sized steps 12 and mezzanine 14 of the staircase 10. The u-channel 62 used to create the front 76 of the lowest step 12 of the staircase 10 will need to be cut to the desired step height before it is secured in place.

After the metal framework for the staircase 10 has thus been constructed and before the concrete is poured to complete the staircase 10, it may be desirable to chink, caulk or otherwise seal any cracks in the formed areas where the concrete will be poured to form the poured concrete stair treads 16 and poured concrete mezzanine floor 18 in order to prevent the wet liquid concrete from seeping out of the formed portion of the framework. Then concrete is poured above the various step boxes 42 and above the platform boxes 40 to the desired depth and the concrete is finished and allowed to dry, thereby structurally completing the staircase 10. The staircase 10 can then be carpeted, painted or otherwise finished to the customer's specifications.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A concrete stair tread staircase frame constructed of standard steel structural components comprising:

a concrete stair tread staircase constructed of standard steel structural components in a building have a plurality of wall studs, two stair stringers attached to said plurality of wall studs of a wall of a building for each flight of stairs such that one stair stringer attaches on one side of a stairwell and the other stair stringer attaches on an opposite side of the stairwell, both stair stringers oriented at an appropriate slope for construction of a staircase, each stair stringer comprised of 2×12 steel stair stringer studs secured to said plurality of wall studs and 2×12 steel stair stringer u-channel secured over each of the 2×12 steel stair stringer studs, ends of the stair stringers being cut at appropriate angles so that the ends are flush with an upper floor and a lower floor to which each flight of stairs attaches within the staircase, a plurality of step boxes, each of the plurality of step boxes constructed of two 2×6 steel step box studs cut to a desire width of steps for the staircase and two 2×6 steel step box u-channels cut to a desired depth of steps for the staircase, said 2×6 steel step box studs and said 2×6 steel step box u-channels secured together at right angles at their ends such that said 2×6 steel step box studs are parallel with each other and said 2×6 steel step box u-channels are parallel with each other within each of the plurality of step boxes, pieces of metal deck material secured to a top of each of the plurality of step boxes to create the bottom of a step form into which concrete is poured to create concrete steps above each of the plurality of step boxes, a plurality of step risers formed from 2×12 steel step riser u-channel cut to the width of the stairs, an upper leg of each of the plurality of step risers extending in the direction of the upper floor to which the flight of stairs attaches within the staircase, an upper leg of an uppermost steel step riser u-channel secured to the upper floor and located at the appropriate height to be level with the upper floor surface that will be created, one of said plurality of step boxes secured to the uppermost steel step riser u-channel and to the stair stringers at the proper level to serve as the floor of a concrete form into which concrete is poured to create concrete steps above the plurality of step boxes to create an uppermost step of the flight of stairs, said plurality of step risers and said plurality of step boxes being secured to each other and to the stair stringers so that the plurality of step risers and the plurality of step boxes are arranged along the stair stringers in alternating order in the proper locations to jointly with the stair stringers create concrete forms for the steps of the staircase, the upper leg of each subsequent step riser being located at the appropriate height to be level with the concrete step that will be created when concrete is poured over the next higher adjacent step box, and the steel step riser u-channel forming a front of the lowest step of the flight of stairs being cut to the desired step height.

2. A concrete stair tread staircase frame according to claim 1 further comprising:

concrete poured in the concrete forms for the steps of the staircase to the desired depth above each of the plurality of step boxes to complete the staircase.

3. A concrete stair tread staircase frame according to claim 2 wherein the upper floor to which and uppermost step riser is secured is an intermediate platform box.

4. A concrete stair tread staircase frame according to claim 3 further comprising:

platform stringers attached to said plurality of wall studs of the wall of the building horizontally around where an intermediate landing will be built and at the appropriate location and height to form a surface against which the intermediate platform box is to be secured, each platform stringer is constructed of 2×12 steel platform stringer studs secured to said plurality of wall studs of the wall of the building and 2×12 steel platform stringer u-channels secured over each of the 2×12 steel platform stringer studs, two 2×12 steel platform studs cut to the width of the landing and two 2×12 steel platform u-channels cut to the depth of the landing, the two 2×12 steel platform studs and the two 2×12 steel platform u-channels secured to the platform stringers and secured to each other at right angles on their ends such that said two 2×12 steel platform studs are parallel with each other and said two 2×12 steel platform u-channels are parallel with each other within the intermediate platform box, additional 2×12 steel platform studs cut to length and attached to the intermediate platform box between said two 2×12 steel platform studs and between said two 2×12 steel platform u-channels to provide additional strength and support to the intermediate platform box as needed depending on the size of the intermediate platform box constructed, and metal deck material secured to the top of the intermediate platform box to create the bottom of an intermediate platform concrete form whose walls are created by the plurality of step risers and platform stringers and into which concrete will later be poured to create the intermediate concrete platform.

5. A concrete stair tread staircase frame according to claim 4 further comprising:

concrete poured to the desired depth above the intermediate platform box in the platform concrete form to complete the intermediate platform.

6. A concrete stair tread staircase frame according to claim 4 wherein the metal deck material used on the intermediate platform box is corrugated.

7. A concrete stair tread staircase frame according to claim 1 wherein the metal deck material used on the plurality of step boxes is corrugated.

* * * * *